United States Patent [19]

Rice, Jr. et al.

[11] Patent Number: 4,772,877

[45] Date of Patent: Sep. 20, 1988

[54] SECURITY INDICATING ATTACHMENT FOR SAFE-TYPE APPARATUS

[75] Inventors: Thomas J. Rice, Jr., Fredericksburg; John R. Thomson, Dahlgren; Vaughn P. McDowell, Fredericksburg; Gregory H. Drescher, King George, all of Va.

[73] Assignee: The United States of America as represented by the Secretary of the Navy, Washington, D.C.

[21] Appl. No.: 27,921

[22] Filed: Mar. 19, 1987

[51] Int. Cl.[4] ..... G08B 13/00; G08B 21/00

[52] U.S. Cl. ..... 340/543; 70/434; 70/DIG. 49; 109/38; 340/540; 340/545

[58] Field of Search ..... 340/543, 542, 545, 540; 70/434, 441, DIG. 49; 109/38, 43, 44

[56] References Cited

U.S. PATENT DOCUMENTS

| | | | |
|---|---|---|---|
| 2,923,928 | 5/1956 | McLaughlin | 340/543 |
| 3,056,125 | 9/1962 | Harry | 340/543 |
| 3,559,593 | 2/1971 | Monton et al. | 109/25 |
| 3,643,249 | 2/1972 | Haywood | 340/542 |
| 3,785,187 | 1/1974 | Wolz | 70/264 |
| 4,453,390 | 6/1984 | Moritz et al. | 340/542 |
| 4,455,552 | 6/1984 | Greiner et al. | 340/543 |

*Primary Examiner*—Glen R. Swann, III

*Attorney, Agent, or Firm*—Elmer E. Goshorn; John D. Lewis

[57] ABSTRACT

This disclosure teaches a battery powered security indicating device which attaches to the drawer of a safe. Sensors send drawer position and combination dial rotation signals to a microprocessor which in turn provides audio and or visual indication to the operator indicating when the drawer is open, when it is properly closed and when it is improperly locked.

10 Claims, 6 Drawing Sheets

SECURITY INDICATING ATTACHMENT FOR SAFE-TYPE APPARATUS

This invention relates to a security indicating attachment for a safe-type apparatus and, more particularly, it relates to an improved electronic security indicating attachment for a safe-type apparatus that not only indicates a door has been opened but also whether a closed door is properly secured.

BACKGROUND OF THE INVENTION

Various types of devices have been designed in the past for indicating in numerous ways whether a safe or the like has been properly secured. For example, U.S. Pat. No. 2,923,928 to McLaughlin discloses a combination lock protective system. The system is generally comprised of a switch actuating arm that is threadably connected to the outer threaded end of a combination lock dial assembly. When the dial is rotated in the right direction a predetermined number of times, a relay is actuated that changes the visual indicating lights from red to green thereby informing the user that the safe is locked. U.S. Pat. No. 3,643,249 to R. E. Haywood relates to a door attachment for indicating its locked condition. The attachment is generally made up of a pivotally and resiliently mounted arm of approximately Z-shaped configuration. The arm is swung into position for engaging the depressed locking plunger of a typical door knob assembly. With the door shut and the arm engaged, a switch engaged by the arm actuates a light on the exterior side of the closed and secured door. U.S. Pat. No. 3,559,593 to E. A. Monton discloses a protective system for controlling authorized unlocking of a security container. The system is generally made up of a drawer safe and a security circuit for preventing unauthorized entry. The system of FIGS. 1 and *2a–2b* is considered pertinent. The security circuit is generally made up of a rotatable dial and a series of interconnected gating circuits operatively associated with and selectively controlled by the predetermined rotation of the dial. The circuit is also provided with a key operated switch for unlocking the door and for actuating the series of gating circuits if the dial has not been properly rotated thereby igniting the fused explosive connected to the circuit and destroying the drawer-stored contents. U.S. Pat. No. 3,785,187 to F. T. Wolz discloses a security system for controlling one or more door safes from a remote location. Each safe is generally made up of a door opening/closing mechanism and a power actuated dead bolt for each door of any safe. A master multi-switch control circuit is operatively associated with each safe and visually indicates by colored lights when the door of any safe is locked or unlocked after the control circuit has selected a command signal for either locked or unlocking the door of any safe. By reason of the switching arrangement of the control circuit for each safe, until the door of a given safe is closed it cannot be locked thereby preventing an improper operation of the control circuit and a false indication of the door's condition at the remote and master control station of the security system.

However, none of the aforediscussed patents for securing safes in some fashion recognized the solution of an improved security indicating attachment for a drawer-safe and the like of any suitable construction where the attachment could be readily attached to the drawer or door of any safe, require minimal and/or low power usage and not only visually indicate when the door has been opened but also when the closed door has been properly secured. At the same time the attachment readily lends itself to be incorporated into a master computerized control system for monitoring a plurality of safes in a secured area having a variety of working conditions therein. Moreover, an improved security indicating attachment of microconstruction for a drawer or door safe and the like is provided as described below that is of simple yet tamper-proof construction and low power usage requirements. Further, it readily lends itself to being easily attached to a door or drawer and at the same time because of its lower power usage requires a simple battery pack for its power supply and minimal servicing such as merely replacing the battery.

SUMMARY OF THE INVENTION

An object of the invention is to provide an improved security indicating attachment that can be readily attached and used on most drawer and door safes.

Another object of the invention is to provide an improved security indicating attachment that not only clearly indicates when a closed door or drawer has been opened but also clearly indicates when the closed drawer has been properly secured.

Still another object of the invention is to provide an improved security indicating attachment of compact and primarily micro-electronic design as well as simple and yet tamper-proof construction.

And further, another object of the invention is to provide an improved security indicating attachment for a door or drawer safe that lends itself to integration into a multiple security indicating attachment arrangement for a master and remote control security system.

And still further, another object of the invention is to provide an improved security indicating attachment that requires minimal power for its operation.

In summary, the improved security attachment for a door or drawer safe and the like is generally made up of a power supply, drawer position sensing means, audio alarm and visual indicating means, and signal generating and detecting means. Micro-processor means is advantageously electrically connected to the power supply, the sensing means, the indicating means and the detecting means. The drawer position sensing means can be any suitable means such as a series of two microswitches for selectively connecting the power supply to both the microprocessor means and the detection means so that the processor means as the result of its novel programming may actuate the audio/visual alarm indicating means when the door is opened or when the closed door is being improperly or properly secured.

The processor chosen for illustration in the drawings is an off-the-shelf microprocessor designated 80C51. Pin connections illustrated in the figures herein correspond to microprocessor 80C51. The one used in the embodiment chosen for illustration is commercially available from Intel Corporation, but 80C51 microprocessors are readily obtainable from various other sources, e.g., OkiData Corporation. Other microprocessors are available that are pin for pin interchangeable with the one illustrated. The processor utilized is considered to be a design choice.

The signal generating and detecting means is advantageously mounted immediately adjacent to and in operative relationship to a drawer-mounted rotatable dial face of a conventional combination lock mechanism for a drawer latching mechanism. Further, the dial face has mounted at a predetermined location thereon signal reflecting means such as a suitable grade of foil. The signal generating and detection means is generally made up of a pair of infrared light emitting diodes (signal generating means) and a pair of photo-sensitive transistors (signal detecting means) or semiconductors. Each light-emitting diode (LED) is parallel connected to the power supply means when the drawer is closed and is operatively associated with its respective transistor of the pair of transistors. At the same time, each diode is disposed in operative relationship with the signal reflecting means as the dial is rotated during attachment use. The signal generating and detecting means is also provided with a pair of field effect transistors separately connected to the processor means and parallel connected to the pair of transistors. When the drawer is closed the generating and detecting means is grounded by one of the microswitches of the sensing means so as to permit operation of the detecting means for determining when the closed drawer is either improperly secured or fully secured within a given time period. By reason of the pair of field effect transistors (FETS) being separately connected to the processor means and by reason of the pair of transistors and the pair of FETs both being responsive to the signal from the pair of LEDs as reflected by the signal reflecting means during dial rotation, the processor is momentarily grounded through the actuated pair of FETs and as the result of the processor being programmed in a novel manner it will ascertain the proper or improper rotation of the dial face including its direction of rotation within a given time period. In other words, after the drawer is closed, the signal generating and detecting means together with the signal reflecting means, the rotary dial and the programmed processor advantageously function as an external interrupt and sequence arrangement for determining if the dial face has been rotated in one direction one or more dial revolutions, opposite directions, or for a predetermined number of dial revolutions in the same direction within a desired time period. As the result of the programmed processor ascertaining at least one of these determinations during any use of the attachment for securing a closed drawer, the processor will then actuate the audio/visual alarm means to indicate that the closed door is being improperly or properly secured.

The power supply can be battery power. To maximize its useful life, the battery-powered power supply can be provided with a magnetically operable relay for controlling connection of the power supply to the processor means and the detecting means. By reason of this relay, the battery-powered power supply is operated intermittently, e.g., only when the door is opened and being fully secured after it is closed.

Further, because of the use of solid state technology, the attachment is of lightweight and compact construction. Also, the various components of the attachment lend themselves to being made up of two packaged elements for affixing to a door or drawer. Thus, the door or drawer position sensing means component of the attachment can be one package, while the power supply, processor means, indicating means and detecting means components of the attachment can be another package.

Other objects and advantages of the invention will become more apparent hereinafter when the detailed description of the invention is taken into account with the accompanying drawings.

DETAILED DESCRIPTION OF THE INVENTION

Figure 1:
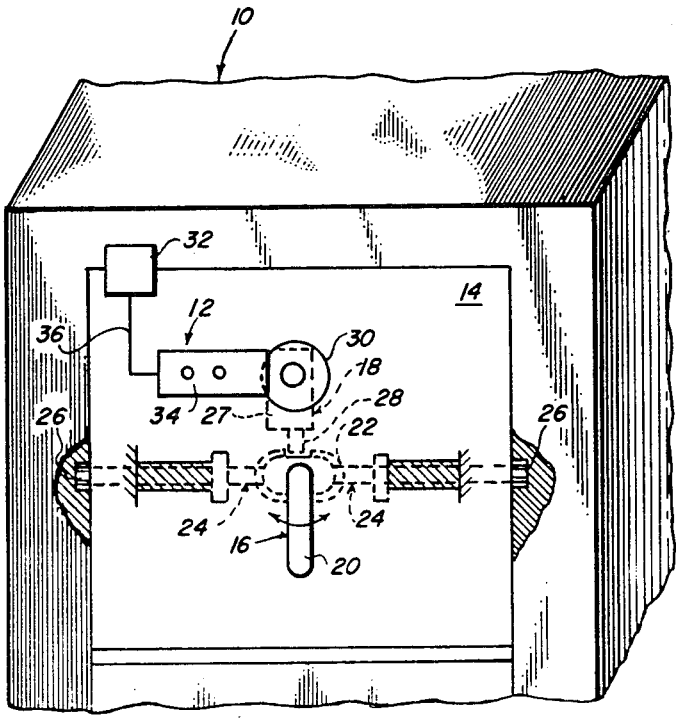
FIG. 1 is a fragmented, perspective view, with certain parts broken away, of a multiple drawer safe and illustrates an improved security indicating attachment of the invention for use with a drawer thereof.

With further reference to FIG. 1, a multiple drawer safe 10 of conventional and well known design is provided with an improved security indicating attachment 12 affixed to a drawer 14 of the safe. The front exposed portion of the drawer is provided with an integral handle-operated latching mechanism 16 for controlling the opening and closing thereof. A suitable combination lock device 18 is also integrally connected to the front exposed portion of drawer 14 and is operatively associated with and connected to latching mechanism 16 for locking latching mechanism in an extended condition so as to secure drawer 14, when fully closed, in a locked condition within the housing of safe 10 as depicted in FIG. 1. Latching mechanism 16 is generally made up of an exposed, manually operable and rotatable handle 20, an internal rotatable cam 22; and a pair of opposed and longitudinally aligned, internally mounted, spring-biased pins 24. When handle 20 is disposed in the upright position as illustrated in FIG. 1, the pins are extended fully outward in opposite directions so as to be inserted in and engaged by opposed pin-receiving sockets 26 provided in the housing of safe 10 thereby latching drawer 14 to the closed position. Lock device 18 is provided with a housing 27 suitably mounted within the interior of the outer face of the drawer. The housing is provided with a tumbler mechanism (not shown) and a pawl mechanism 28 depending therefrom. Since the tumbler mechanism is interconnected to an exposed rotatable dial face 30 and pawl mechanism 28, and depending upon the rotation of dial 30 about its axis 29 (FIG. 2), the pawl is either in a retracted or extended condition for engaging and locking cam 22 of the latching mechanism when the door is closed and handle 20 is disposed in its upright position as shown in FIG. 1. As further evident in FIG. 2, dial face 30 is provided with graduated indicia that are referenced in relation to a fixed reference point 31. The reference point is located on the outer periphery of a fixed and drawer-mounted assembly 33 for rotatably supporting the dial face. In order to assure that drawer 14 is properly secured and latched in relation to safe 10, improved attachment 12 is advantageously provided as will now be described.

The attachment is provided with a package 32 that is preferably mounted along the upper edge of the drawer for enclosing sensing means that sense when drawer 18 is either opened or closed in relation to the housing of safe 10. The attachment is also provided with another package 34 of larger construction and affixed to the drawer in operative relation to dial 30. As will be more fully explained hereinafter, package 34 encloses other components of the attachment that are electrically interconnected by a cable 36 to the sensing components within package 32.

Figure 2A:
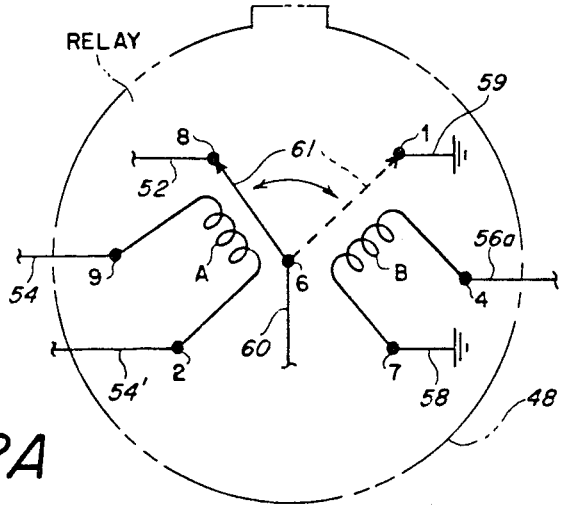
FIG. 2A is a diagrammatic view with parts added and other parts removed as taken within the bounds of encompassing line 2A—2A of FIG. 2 and illustrates further details of the magnetic relay.
Figure 2:
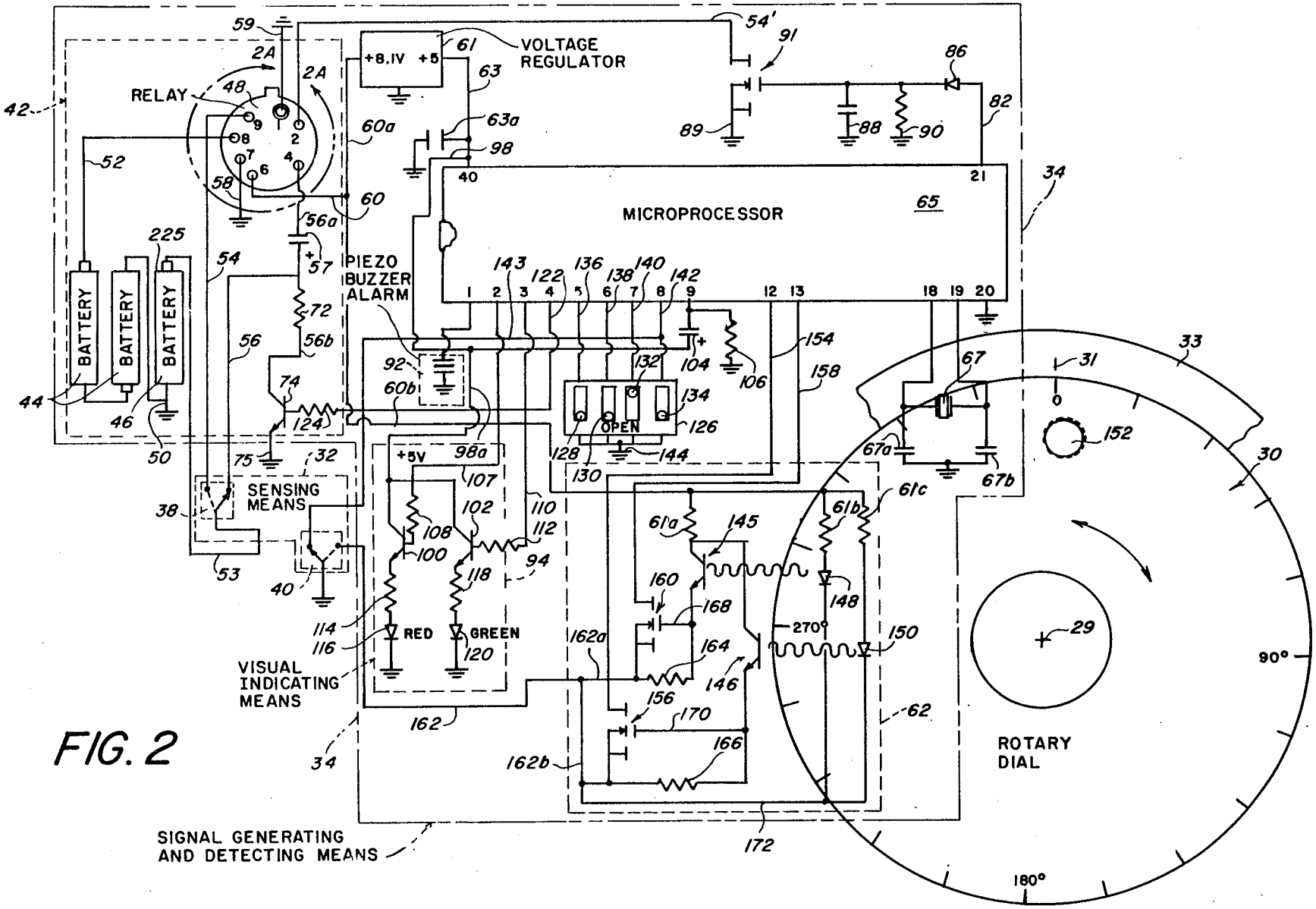
FIG. 2 is a combined schematic and diagrammatic view, with some parts broken away, and illustrates various components of the attachment in electrically interconnected relation to each other as well as in operative relationship to the rotatable dial face of a drawer combination lock to the safe of FIG. 1.

As illustrated in FIG. 2, the drawer-position sensing means of package 32 is generally made up of a pair of switch means 38 and 40 such that the pivotally mounted arm or bridge contact of either switch is spring biased to one of its two contact terminal engaging positions when the drawer is in an open condition as shown by the arrowed solid lines for the bridge contacts of switches 38 and 40. Power supply 42 of package 34 is generally made up of a pair of series-connected batteries 44 and 44, a single battery 46 and a latch-operated magnetic relay 48. A common ground 50 is parallel connected to battery 46 and the cathode of one of the pair of batteries 44. A lead 52 connects the output of the pair of batteries 44 to an input terminal 8 of relay 48 as designated in FIG. 2A. A lead 53 connects anode of battery 46 to the bridge contact terminal of switch 38. Another lead 54 connects the normally-open terminal contact of switch 38 to a terminal 9 of a coil A of relay 48 as best illustrated in FIG. 2A. Another terminal 2 of coil A is connected to a lead 54'. A lead 56 interconnects via its branch lead **56*a* the normally closed contact of switch 38 to a terminal 4 of a coil B of relay 48. A capacitor 57 is connected to branch lead 56*a*. Another terminal 7 of coil B is grounded by a lead 58. Terminal 1 of relay 48 is also grounded by a lead 59. A lead 60 is connected to terminal 6 of relay 48 and to the magnetically actuated latch or bridge contact 61 thereof. when drawer 14 is opened, switch 38 returns to its spring-biased position connecting lines 53 and 56. A current path now exists for battery 46 to charge capacitor 57 which in turn causes relay contact 61 to connect relay terminal 8 and 6. This connects power from batteries 44 and 44 through lead 52, terminal 8 and 6 of relay 48, lead 60, 60*a* and through the voltage regulator 61', down lead 63 to input pin 40 of the microprocessor, thus energizing microprocessor 65**.

Branch lead **60*a* is connected to a voltage regulator 61. Branch lead 60*b* is parallel connected to a series of three resistors 61*a*, 61*b*, and 61*c* of a signal generating and detecting means 62 of package 34. Output lead 63 of regulator 61 is connected to the input terminal 40 of a microprocessor 65. A grounded capacitor 63*a* is parallel connected to lead 63 and prevents a power surge to processor 65 when lead 63 is energized. When bridge contact 61 of relay 48 is in its solid line position as shown in FIG. 2A, microprocessor 65 is energized by batteries 44 and 44 being connected thereto through leads 60 and 60*a*, regulator 61 and lead 63. At the same time resistors 61*a*, 61*b* and 61*c* of detecting means 62 are energized by batteries 44 and 44 through lead 60*b***.

A crystal 67 is parallel connected to grounded capacitors **67*a* and 67*b* and across terminals 18 and 19 of microprocessor 65 so as to complete the oscillator circuit thereof. As illustrated in FIG. 2, branch lead 56*b* is provided with a resistor 72 series connected to the collector of a transistor 74. Emitter 75** of the transistor is grounded.

A lead 82 at one end is connected to an output terminal 21 of microprocessor 65. A diode 86 is series connected to lead 82. At the same time a grounded capacitor 88 and a grounded resistor 90 are parallel connected to lead 82 between diode 86 and the gate of a field effect transistor (FET) 91. The drain of FET 91 is connected to lead 54'. The source of the FET is grounded by a lead 89.

An audio alarm 92 is connected to pin 1 of microprocessor 65. A lead 98 interconnects lead 63 to a capacitor 104 which is connected to pin 9 of the processor. A resistor 106 is parallel connected to capacitor 104 and terminal 9. When drawer 14 is opened, processor 65 is energized (see specification page 11, line 20 to page 12, line 19, for more detailed description of microprocessor energization.). At the same time capacitor 104 is charged by batteries 44 and 44 through leads 52, 60, **60*a*, 63 and 98, relay 48 and regulator 61**; and functions to reset the registers of the processor.

Package 34 is also comprised of visual indicating means 94. As further illustrated in FIG. 2, a branch lead **98*a* of power input lead 98 is parallel connected to the collectors of a pair of transistors 100 and 102. A lead 107 having a resistor 108 is connected to pin 2 of microprocessor 65 and also to the base of transistor 100. Similarly, a lead 110 having a resistor 112 is connected to pin 3 of the microprocessor and also to the base of transistor 102. The emitter of transistor 100 has a resistor 114 and a light emitting diode (LED) 116 series connected thereto. Similarly, the emitter of transistor 102 has a resistor 118 and a LED 120 series connected thereto. It is noted here that LEDs 116 and 120 are grounded and are also provided with different colored lens covers such that LED 116 preferably glows red when activated while LED 120** preferably glows green.

A lead 122 having a resistor 124 connects pin 4 of microprocessor 65 to the base of transistor 74. Although not heretofore mentioned when drawer 14 is properly secured after being closed and locked, processor 65 provides an output from pin 21 through lead 82 and diode 86 and charges capacitor 88. With capacitor 88 charged, FET 91 is activated thereby rendering lead 54' conductive through grounded FET 91. With lead 54' conductive, coil A of relay 48 is energized by battery 46 through interconnected leads 53 and 54 across switch 38. Energized coil A then forces relay contact 61 from terminal 8 to terminal 1 of relay 48 so as to cut off the power input from batteries 44 and 44 to processor 65 by way of relay interconnected leads 52 and 60 through relay terminals 8 and 6, lead **60*a*, regulator 61 and lead 63**.

An external manually operable multiple two-position switch device 126 is connected to a series of four processor pins 5 through 8 as depicted in FIG. 2. The device is provided with a series of four two-position switches 128, 130, 132 and 134. One side of each switch 128, 130, 132 or 134 is separately connected by a lead 136, 138, 140 or 142 to its associated processor pin 5, 6, 7 or 8. The other side of each switch 128, 130, 132 or 134 is parallel connected to a common ground 144. A lead 143 parallel connects one switch lead 142 to the normally closed terminal contact of switch 40. One of the reasons that lead 143 interconnects processor pin 8 and the normally closed terminal contact of switch 40 is that pin 8 will be grounded through switch 40 and thus a low when drawer 14 is open. Further, by reason of switch device 126, it can readily be encoded, such as shown in FIG. 2, to match the programming of processor 65 and assure the proper operation of attachment 12 as hereinafter described.

With further reference to the signal generating and detecting means 62 of package 34 as depicted in FIG. 2, the collectors of a pair of infrared photo responsive transistors 145 and 146 are parallel connected to resistor 61*a*. An infrared LED 148 is connected to resistor 61*b* and an infrared LED 150 is connected to resistor 61*c*. LEDs 148 and 150 are each optically aligned and operatively associated with its respective photo responsive base of transistor 145 or 146. A signal reflection element 152 of a suitable grade of aluminum foil and the like and of disc-like shape is mounted on the outer face of dial 30 such that it is radially aligned with indicia "0" on the outer face thereof. At the same time, the reflection element is disposed on the outer face of dial 30 so as to be operatively associated and circumferentially aligned with diodes 148 and 150 when dial face 30 is rotated about its axis. As is evident from FIG. 2, diode 148 and transistor 145 are laterally aligned such that when element 152 passes underneath diode 148 during rotation of dial 30, the infrared light of diode 148 is intercepted and reflected by element back to the base of transistor 145. Similarly, diode 150 and the base of transistor 146 are laterally aligned but offset from diode 148 and transistor 145 such that when the reflection element passes underneath diode 150, light is intercepted and reflected to the base of transistor 146. A lead 154 connects pin 12 of microprocessor 65 to the drain of an FET 156. Similarly, a lead 158 connects pin 13 of the microprocessor to the drain of an FET 160. A lead 162 is connected to the normally-open terminal contact of switch 40. The emitters of transistors 145 and 146 have resistors 164 and 166 connected thereto. Branch leads 168 and 170 of the emitters of transistors 145 and 146 are parallel connected to the gates of FETS 160 and 156 respectively. Resistors 164 and 166 are connected to branch leads 162*a* and 162*b* and to branch leads 168 and 170. Branch leads 162*a* and 162*b* are also connected to the sources of FETs 160 and 156. A lead 172 parallel connects the current flow of LEDs 148 and 150 to branch lead 162. As will become more apparent hereinafter and by reason of the relationship between FET 160 and transistor 145, and between FET 156 and transistor 146, an external and grounded interrupt is provided for the processor through its pins 12 and 13 and grounded switch 40 when closed drawer 14 is being secured as dial 30 with its reflection element 152 is rotated in either direction about its axis 31 relative to LEDs 148 and 150.

In an operative embodiment of attachment 12 as used on safe 10, it is assumed that drawer 14 is closed and fully secured prior to opening the drawer and securing same as will now be described. With reference to the flow chart (main routine) of FIG. 3A and with the drawer opened, program block 180 initializes processor interrupts and registers. At this time block 188 indicates drawer 14 is open because bridge contacts of switches 38 and 40 of drawer positioning sensing means 32 are in their solid line positions as shown in FIG. 2. Further, relay coil B is energized by charging of capacitor 57 and thus relay latch 61 is pivoted from its dotted line position to its solid line position (see FIG. 2A) thereby energizing processor 65 and signal generating and detecting means 62 by way of batteries 44 and 44 through relay terminals 6 and 8, interconnecting leads 52, 60, 60*a* and 63 and regulator 61 to processor pin 40; and through relay terminals 6 and 8 and interconnecting leads 52, 60 and 60*b* to signal generating and detecting means 62. At the same time, through grounded switch 40, pin 8 of processor 65 is maintained low until the opened drawer is closed. Then, if block 190 of the drawer open subroutine indicates register RO is equal to FF hex, then LED 116 of the visual indicating means is actuated (see program block 191) as result of a high pulse coming from pin 2 of the processor via lead 107 and as result of previous energization of collector of transistor 100 by branch lead 98*a* being connected to power input lead 98. At the same time, audio alarm 92 is actuated by a high/low signal from processor pin 1 that has a particular frequency for indicating the drawer is open. Then after a predetermined time period, block 191' sets register RO to zero and the drawer subroutine is reexecuted until the drawer is closed.

When drawer is closed delay block 189 of the main routine permits circuits of attachment 12 to stabilize as result of the bridge contacts of switches 38 and 40 being moved from their solid line positions to their dotted line positions. Then switch 38 interconnects battery 46 via leads 53 and 54 to relay terminal 9 and one side of coil A. Until FET 91 is conductive by way of processor pin 21 and lead 82 as aforedescribed, lead 54' is nonconductive and relay coil A is nonenergized, thereby leaving relay contact 61 in its solid line position for interconnecting batteries 44 and 44 to processor 65 and detecting means 62. With the drawer closed, the bridge contact of switch 40 is in its dotted line position thereby grounding detecting means 62 via lead 162 and actuating LEDs 148 and 150 so that detecting means 62 is operable when dial 30 is rotated.

After delay block 189, external interrupts designated I0 (relating to FET 156) and I1 (relating to FET 160) are subjected to their separate subroutines as indicated by the series of three program blocks 192, 193 and 193' or 194, 195 and 195'. Then as indicated by program blocks 196 and 196A, timer "T0" and the processor internal interrupts are enabled and registers RO, R1 and R2 are set to zero, five and five respectively. Then block 197 initializes R6 and R7 to zero before external interrupts I0 and I1 are enabled as indicated by block 197A.

Assume that dial 30 is rotated in a clockwise direction as viewed in FIG. 2. Then reflection element 152 will intercept and reflect light from diode 150 (external interrupt I0) thereby actuating transistor 146 and FET 156; and leads 154 and 162*b* are grounded via switch 40, thus processor pin 12 is externally interrupted and goes low. At the same time, since external interrupt I0 subroutine has been actuated by the grounding of processor pin 12 as the result of the interception and reflection of light from diode 150 by element 152, register R6 is set by the processor to FF hex. Assuming that dial 30 is being rotated clockwise within a time period of timer "T0", block 198 will indicate register "R0" is not equal to EF hex and a block 200 will indicate that register R6 is FF hex as result of external interrupt I0 subroutine being actuated when process pin 12 was grounded as aforementioned. Also, since dial 30 has not been rotated clockwise a predetermined number of revolutions, five (5) i.e., a decision block 202 will indicate R1 is not equal to zero.

Then with continued clockwise rotation of dial 30, element 152 will next intercept and reflect light from diode 148 (external interrupt "I1"). As the result of this interception and assuming that dial 30 is being rotated within a time period of timer "T0", a decision block 204 will indicate register "R0" is not equal to EF hex and block 206 will indicate that external interrupt I1 subroutine has been actuated with register "R7" being set to FF hex.

Figure 3A:
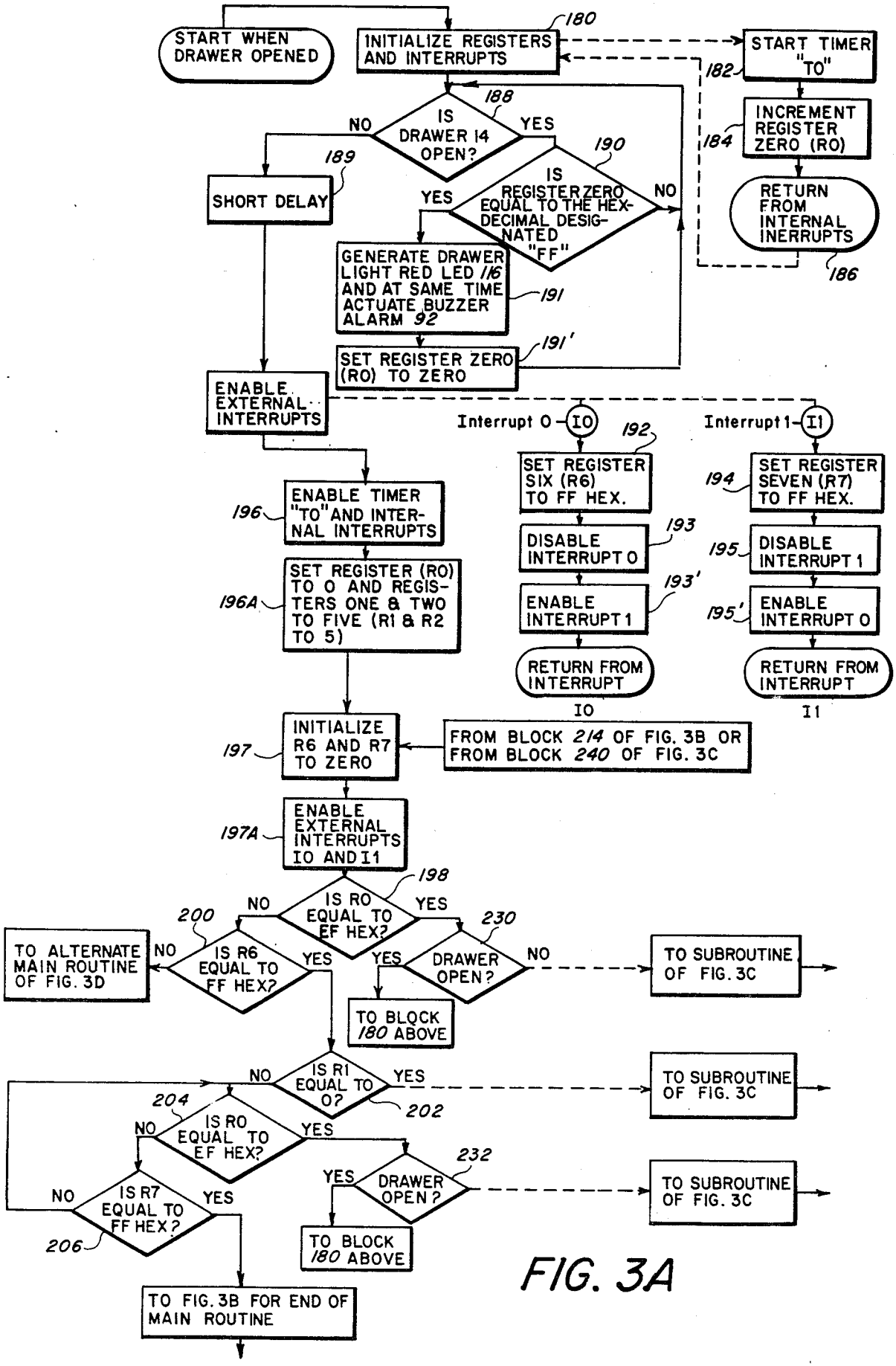
FIGS. 3A-3D are a schematic drawing of a flow chart of an operative embodiment of the improved attachment of the invention.
Figure 3B:
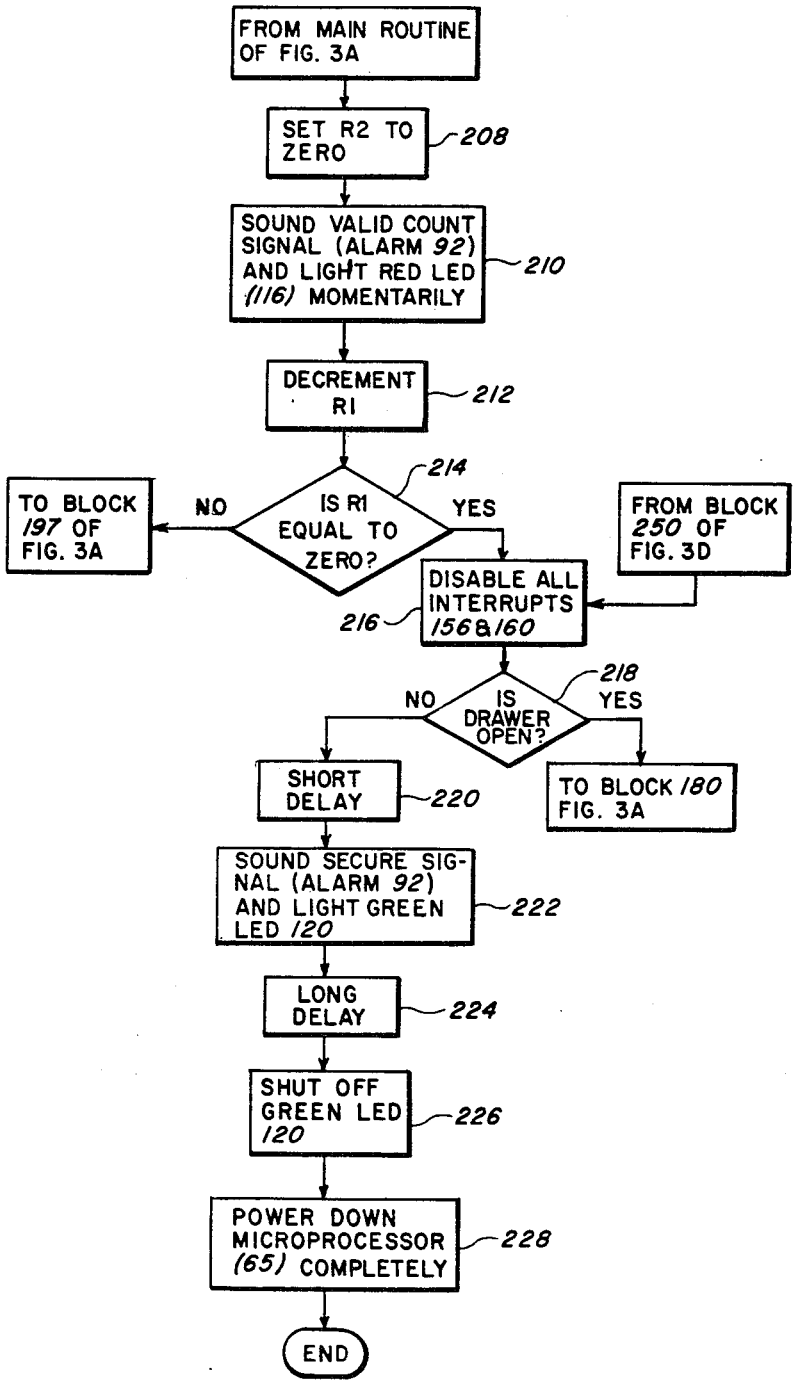

With reference to FIG. 3B for continuance of the main routine, a program block 208 sets register R2 to zero with dial being rotated clockwise from "I0" to "I1" and a program block 210 indicates that processor 65 via pins 1 and 2 momentarily actuates LED 116 and momentarily beeps alarm 92 so as to indicate a valid single clockwise rotation of dial 30. Assuming that it is the first clockwise rotation of dial 30 past I0 and I1 in proper timely sequence, a program block 212 decrements register "R1" from 5 to 4 indicating one clockwise revolution of dial. Then a decision block 214 indicates that register R1 is not zero. Then program execution jumps back to the main routine of FIG. 3A from block 214 to interim program block 197 so that an interim part of the main routine is repeated and repeated as aforedescribed as the dial is continuously rotated clockwise within a time period of timer "T0" until register R1 is progressively decremented from its initial setting of five to zero as will be determined by block 214.

With block 214 indicating register R1 is zero, a program block 216 indicates that processor 65 disables external interrupts I0 and I1. Then assuming drawer 14 is still closed (no tampering), a decision block 218 will so indicate. Then after a short program delay, block 220, processor sends a signal to pins 1 and 3 for actuating alarm 92 at a particular frequency and LED 120 all for indicating closed drawer 14 has been properly secured. Then after a program delay and the processor shutting off LED 120, and as indicated by program blocks 224 and 226, processor 65 is programmed to a power down mode (block 228). At this time, processor pin 21 sends a signal for energizing capacitor 88 that causes FET 91 to conduct. With FET conductive, lead 54' is grounded and coil A becomes energized thereby advancing relay latch 61 from its solid line position to its dotted line position (FIG. 2A) thereby disconnecting processor 65 and detecting means 62 from batteries 44 and 44. Further, the processor during block 228 causes pin 4 to go high and thereby actuates transistor 74 via lead 122. Actuation of transistor 74 causes capacitor 57 to discharge through resistor 72 to ground 75 because switch 38 is in its dotted line position with the drawer closed. In view of the foregoing, it is evident that when dial 30 is continuously rotated four revolutions past I0 and I1 within the time period of timer "T0" and the drawer closed, attachment 12 will indicate drawer 14 as properly secured.

Returning to the main routine of FIG. 3A and for some reason the dial is not turned clockwise for four continuous revolutions within the time period of timer "T0" after I0 and I1 have been enabled by block 197A, then register R0 will not equal FF hex as determined by block 198. Then if the processor, via switches 38, 40 and 126, determines that the drawer is open, a decision block 230 returns the main routine to program block 180 and the drawer open and timer subroutines until the drawer is closed.

Figure 3C:
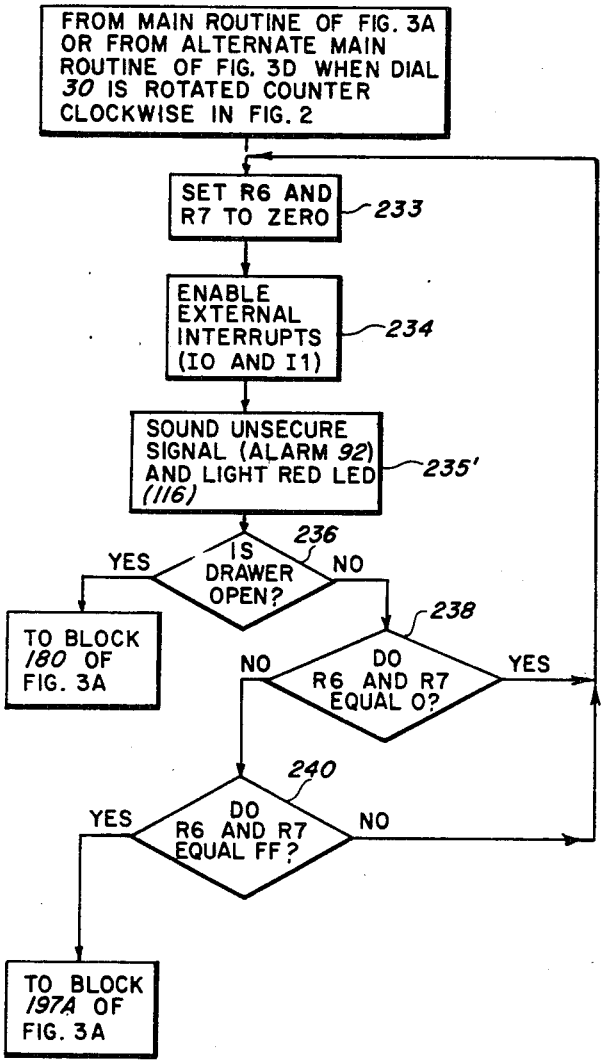

However, if the drawer is closed block 230 directs the processor through the subroutine of FIG. 3C via a program block 233, where processor 65 sets registers R6 and R7 to zero. Then as indicated by a block 234, interrupts I0 and I1 are enabled. Also, as indicated by a block 235', audio alarm 92 is energized at a particular frequency and LED 116 is also actuated for indicating that the closed drawer is improperly secured. Via a decision block 236, the processor determines that the drawer is not open. When dial 30 is again rotated, say in a clockwise direction, the processor via a block 238 will determine that registers R6 and R7 are not equal to zero. Then when element 152 passes both interrupts I0 and I1, the processor via a decision block 240 will determine that registers R6 and R7 are equal to FF hex and the processor will return to block 197A of the main routine for resecuring drawer 14 in the manner aforedescribed as the dial is rotated clockwise.

Assume that dial 30 is rotated clockwise in FIG. 2 past I0 and then its direction reversed so that element 152 triggers I1 before triggering I0. The processor via a decision block 202 will determine that register R1 is equal to zero. Then the processor is directed by the software through the subroutine of FIG. 3C until the processor determines that the attachment is ready to return to the main routine at block 197A of FIG. 3A.

Also assume that as the dial is being rotated clockwise in FIG. 2 that for some reason too much time was taken after the processor software passed program block 202. Then eventually register "R0" will equal EF hex indicating that too much time has been taken in rotating the dial. Then the processor is directed by block 204 to a block 232. If the drawer is closed the processor is directed by block 232 through the subroutine of FIG. 3C as aforedescribed.

Returning to the main routine in FIG. 3A and after block 197A, assume that dial 30 is rotated in a counterclockwise direction in FIG. 2. Then with dial 30 being timely rotated, element 152 would first trigger I1 (transistor 145 and FET 160) thereby setting register R7 to FF hex. Program block 200 would indicate register R6 is not FF hex and direct processor 65 to the altenate main routine of FIG. 3D. If the dial is being rotated counterclockwise, the processor via a decision block 235 will so determine. Then since interrupt I1 has been triggered first and less than four counterclockwise revolutions of dial 30 have occurred, register R7 will be FF hex and register R2 will not be zero as indicated by blocks 237 and 239. Then dial 30 still being timely rotated counterclockwise, register R0 will not be EF hex as indicated by a block 241. Then interrupt I0 will be triggered by element 152 after interrupt I1 and register R6 will be FF hex as indicated by a block 242.

With the dial being continuously rotated counterclockwise, register R1 is set to zero as indicated by a block 244. The processor then momentarily actuates alarm 92 and LED 116 to indicate a valid count for one counterclockwise revolution of dial as depicted by a block 246. Register, R2 is then decremented once for one revolution (a block 248) and if the register is not decremented to zero as determined by a block 250 then the processor is returned to block 197 of the main routine of FIG. 3A. With continued counterclockwise rotation of dial 30 and with register R2 decremented to zero after four counterclockwise revolutions of dial element 152 past interrupts I1 and I0, the processor is directed by a block 250 of FIG. 3D to block 216 of the main routine of FIG. 3B. Then when the processor software determines that the drawer is properly secured alarm 92 and LED 120 are actuated to so indicate, block 222.

Figure 3D:
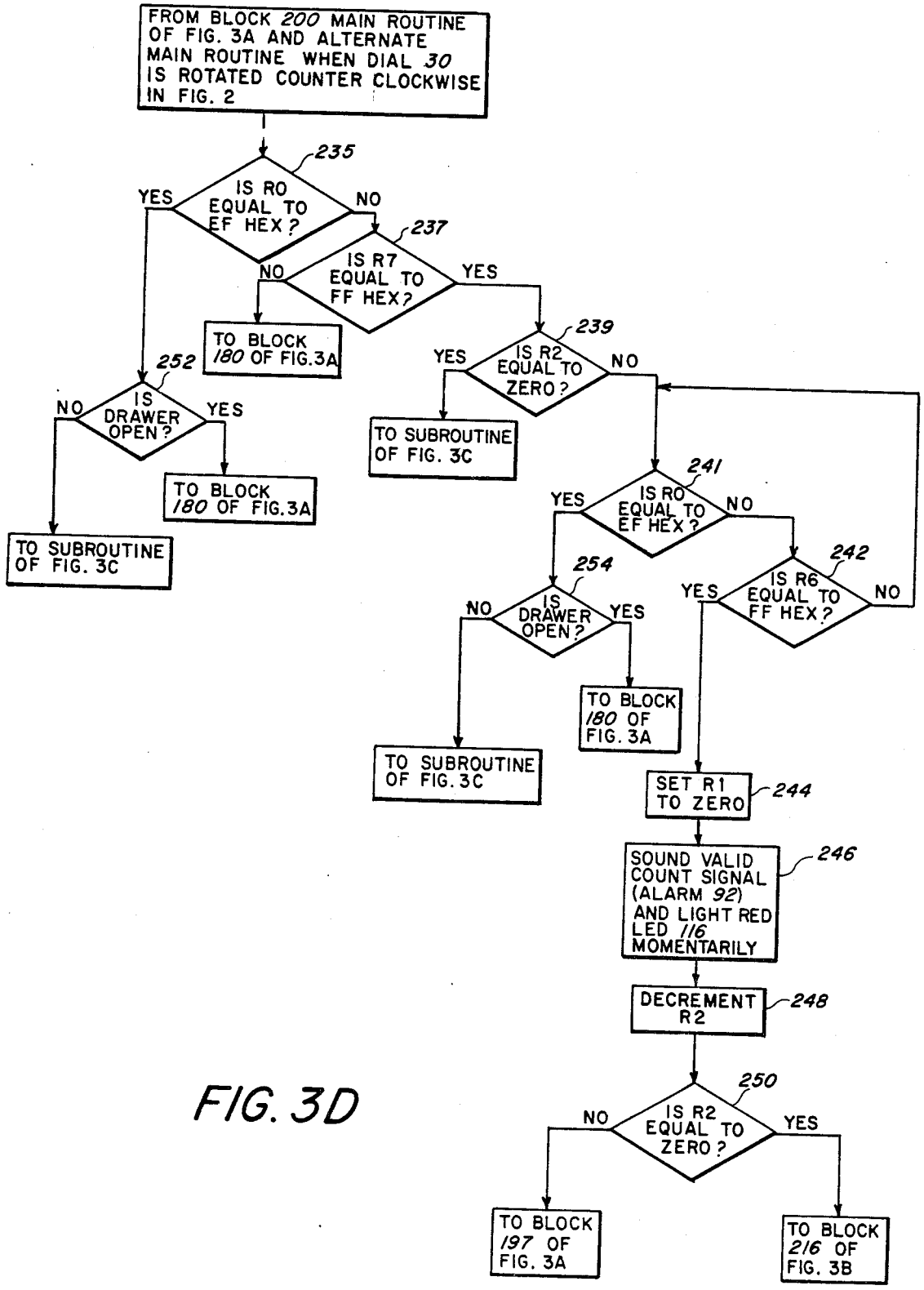

With further reference to FIG. 3D, if the dial is not timely rotated counterclockwise and if the dial is rotated clockwise (reversed during counterclockwise rotation), the alternate software routines, e.g., blocks 252 and 254 are believed to be self-explanatory in view of the alternate routines aforedescribed for processor 65 as represented by blocks 198, 200, 202 and 204 when dial 30 was rotated clockwise and then reversed rotated counterclockwise.

In view of the aforedescribed software routines for processor 65 in conjunction with its interaction with rotation of dial 30 in either direction and the operative association of dial rotation via its element 152 with processor external interrupts I0 and I1, improved attachment 12 provides an effective tamper-proof drawer security indicating device of simple and compact construction.

In one reduction to practice each battery 44 of power supply 42 was four and five hundredths (4.05) volts, battery 46 thereof was twenty-two and a half (22.5) volts, and regulator 57 provided an output of five (5.0) volts via lead 63 to processor 65 and an output of eight and one tenths (8.10) volts via lead **60*b* to energize transistors 145 and 146 and LEDs 148 and 150 of detecting means 34. With this power supply an Intel Microprocessor designated 80C51 was utilized. Although not heretofore mentioned, it is to be understood that components 32 and 34 could be mounted in a suitable manner internally of the outer face of drawer 14**.

Obviously, many modifications and variations of the present invention are possible in light of the above teachings. It is therefore to be understood that, within the scope of the appended claims, the invention may be practiced otherwise than as specifically described.

What is claimed is:

1. A security indicating attachment for a safe having one or more lock-securable drawers therein, the drawer having locking means provided with a manually rotatable dial on the exterior face of the drawer, comprising:

a power supply and microprocessor mounted on the drawer;

means for reflecting a signal mounted on said dial at a selected location thereof, signal generating and detecting means mounted in spaced relation to said microprocessor and said dial.

means for sensing mounted on the drawer for sensing when the drawer is open or closed in relation to the safe, said means for sensing being comprised of first and second switches, said first and second switches being separately operable to one position when the drawer is open and separately operable to another position when the drawer is closed, said first switch having leads for connecting said microprocessor for energizing same and for connecting said signal generating and detecting means to said power supply all when said first switch is in its other operable position and the drawer is closed, said second switch having leads for connecting an output of said microprocessor to ground when said second switch is in the one operable position and the drawer is in an open position; said second switch also having leads for connecting said signal generating and detecting means to ground thereby enabling energization of said signal generating and detecting means by said power supply through said first switch in its other operable position when said second switch is also in its other operable position and the drawer is closed, said signal generating and detecting means being comprised of first and second signal generating means and first and second signal detecting means, said first and second signal detecting means and the first and second signal generating means all being disposed in relatively spaced and operative relation to the rotation of said dial and said means for reflecting, the first and second signal generating means and the first and second signal detecting means all being connected to ground when said second switch is in its other operable position the first and second signal detecting means each being separately interconnected to said microprocessor and each being in a nonconductive state unless the first and second signal detecting means intercept reflected signals from the first and second signal generating means by way of said means for reflecting as said dial is continuously rotated during a given time period a predetermined number of revolutions in one direction relative to the signal generating and detecting means when the drawer is closed; each interception by the first and second signal detecting means of the reflected signal of the first and second signal generating means via said means for reflecting momentarily grounding the connection of said microprocessor through the first and second signal detecting means and said second switch in its other operable position; and means for producing both an audio and visual signal separately connected to said microprocessor whereby an audio alarm and a visual signal is produced when the drawer is properly secured.

2. An attachment as set forth in claim 1 wherein said means for producing a visual signal is comprised of two or more different colored light emitting diodes.

3. An attachment as set forth in claim 1 wherein said means for reflecting is a suitable grade of foil material.

4. An attachment as set forth in claim 1 wherein the first and second signal generating means are comprised of first and second infrared light emitting diodes.

5. An attachment as set forth in claim 4 wherein said first and second signal detecting means are photo responsive semiconductors responsive to said first and second light emitting diodes.

6. An attachment as set forth in claim 1 wherein said power supply is comprised of batteries and magnetic relays.

7. An attachment as set forth in claim 1 wherein said microprocessor is programmed to actuate said means for producing an audio and visual signal when the drawer is open.

8. An attachment as set forth in claim 1 wherein said microprocessor is programmed to actuate said means for producing an audio and visual signal when the drawer is improperly secured by failing to rotate said dial the requisite number of rotations.

9. An attachment as set forth in claim 1 wherein said power supply, microprocessor, means for producing an audio and visual signal and signal generating and detecting means are all packaged together in one enclosure.

10. An attachment as set forth in claim 9 wherein said means for sensing is packaged in a separate enclosure.

* * * * *